United States Patent [19]

Petersdorff et al.

[11] Patent Number: 4,584,856

[45] Date of Patent: Apr. 29, 1986

[54] SECURITY COVER

[76] Inventors: George D. Petersdorff, 162 S. Greeley, Palatine, Ill. 60067; Keith J. Neilson, 1908 Capri Dr., Palatine, Ill. 60074; Jimmie L. Curls, 210 W. Willow Rd., Prospect Heights, Ill. 60070

[21] Appl. No.: 569,920

[22] Filed: Jan. 11, 1984

[51] Int. Cl.[4] ..... E05B 65/00

[52] U.S. Cl. ..... 70/57; 70/167; 70/168; 70/169; 70/235; 70/DIG. 57; 70/DIG. 72; 339/37

[58] Field of Search ..... 70/163, 166, 167, 57, 70/DIG. 72, 137, 139, DIG. 57, 229, 168, 232, 169, 158; 339/37, 82, 36; 179/14, 189 R

[56] References Cited

U.S. PATENT DOCUMENTS

| | | | |
|---|---|---|---|
| 1,271,096 | 7/1918 | Stewart et al. | 70/166 |
| 1,929,679 | 10/1933 | Duncan | 70/169 |
| 1,991,181 | 2/1935 | Smith | 70/232 |
| 2,124,035 | 7/1938 | Hurd | 70/232 |
| 2,175,353 | 10/1939 | Jacobi | 70/169 |
| 2,337,627 | 12/1943 | Schatzman | 70/232 |
| 2,535,126 | 12/1950 | Flowers et al. | 70/169 |
| 3,131,985 | 5/1964 | Blonder | 70/57 X |
| 3,248,915 | 5/1966 | Scheiman | 70/168 |
| 3,734,335 | 5/1973 | Lincoln | 70/137 X |
| 4,051,790 | 10/1977 | Meditz et al. | 70/DIG. 57 X |
| 4,488,764 | 12/1984 | Pfenning et al. | 70/57 X |

FOREIGN PATENT DOCUMENTS

| | | | |
|---|---|---|---|
| 481301 | 5/1976 | Australia | 70/451 |
| 1013163 | 7/1977 | Canada | 70/167 |
| 329696 | 9/1935 | Italy | 70/232 |
| 1245832 | 9/1971 | United Kingdom | 70/168 |

*Primary Examiner*—Robert L. Wolfe
*Assistant Examiner*—Lloyd A. Gall
*Attorney, Agent, or Firm*—Lee, Smith & Zickert

[57] ABSTRACT

A security cover lockably engageable with surface mounted apparatus for preventing unauthorized access to the apparatus. The security cover includes a shell with peripheral sides which closely conform to the size of the apparatus over which it fits, and a pair of tangs on the shell edge wedgable between the apparatus and the surface. A key lock is mounted within the outer surface of the protective cover and includes a slotted finger rotatable with the lock cylinder. The fastener with which the apparatus is fixed to the surface is replaced by a double-headed fastener and is engageable with the slotted finger to thereby lock the protective cover to the apparatus. In the alternative, another apparatus screw is replaced with a double-headed fastener and, instead of tangs, a side edge of the cover is slotted for engagement with the second double-headed screw.

5 Claims, 5 Drawing Figures

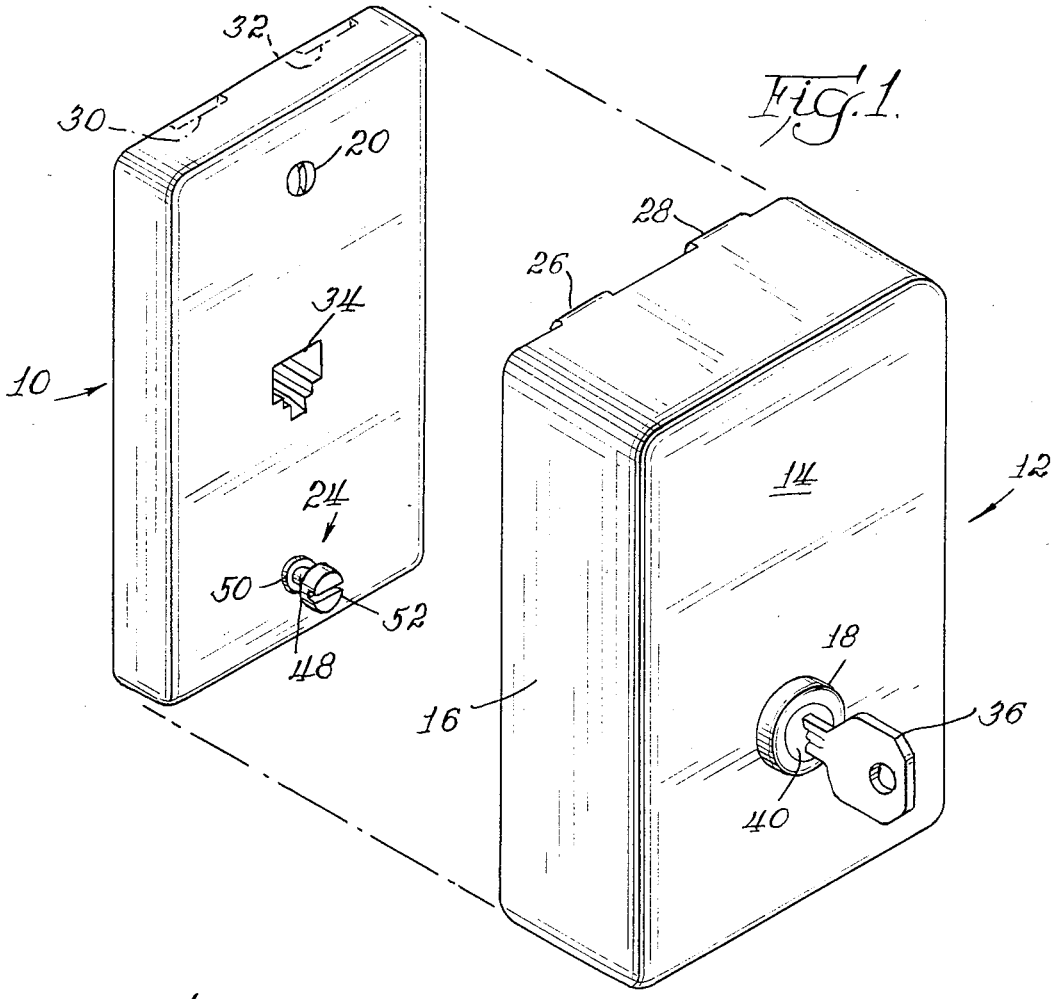
Fig. 1.
Fig. 3.
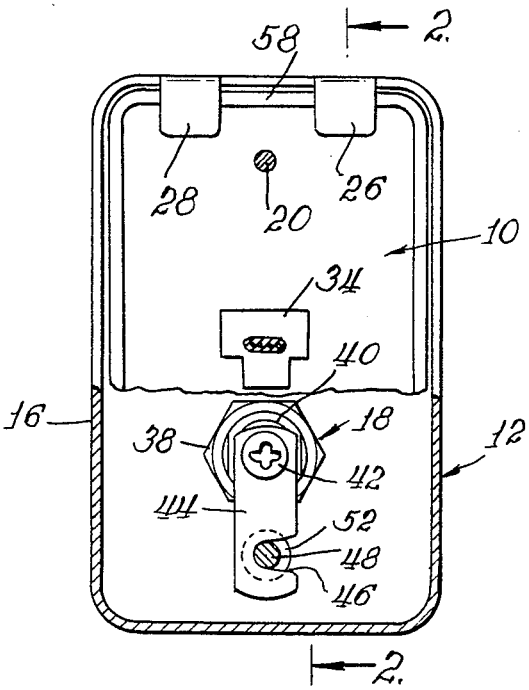
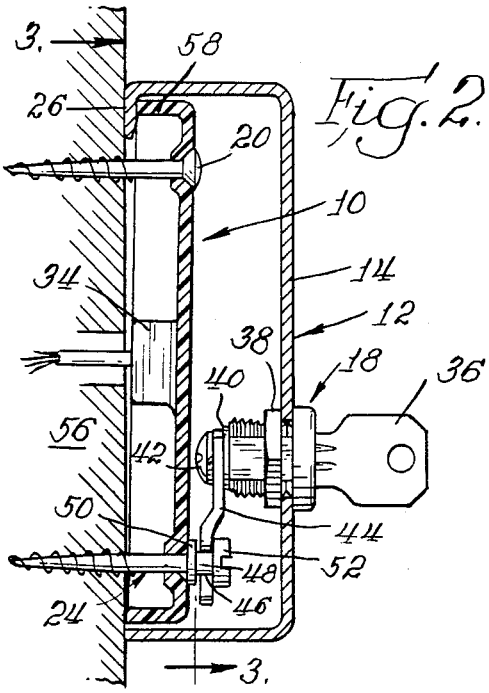
Fig. 2.

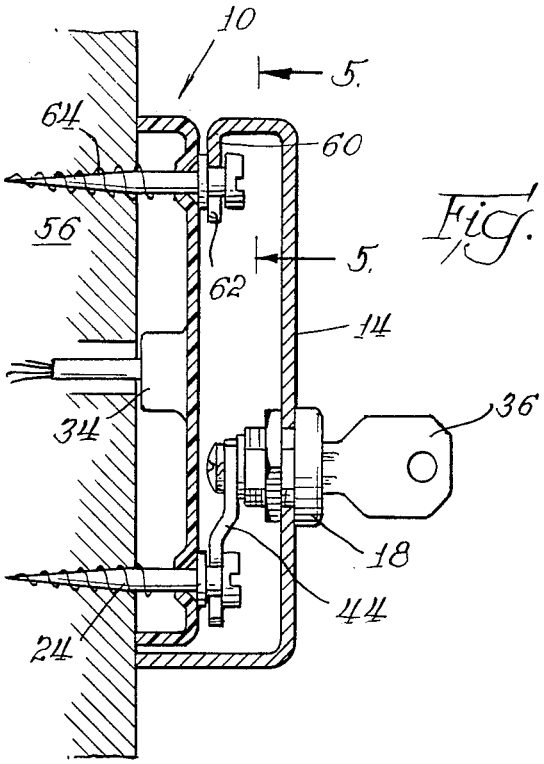
Fig. 4
Fig. 5
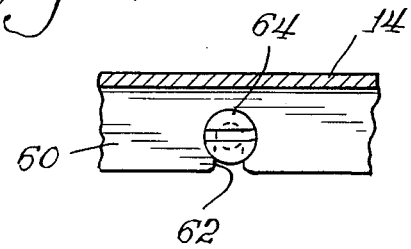

SECURITY COVER

BACKGROUND AND SUMMARY OF THE INVENTION

The present invention generally relates to protective covers for preventing the unauthorized access to the apparatus. More particularly, the invention relates to covers which are lockably engageable to the apparatus, and accessible only to persons with appropriate keys.

The problem of preventing the unauthorized access to utility services, such as thermostats and electrical outlets, remains essentially unsolved. This is especially true as many needs require a highly secure, but portable or removable cover. The problem is further compounded with the prevalent use of standard wall-mounted telephone jacks, and the now-standard plugin telephone. While the plugability of various types of telephone sets into a wall socket provides a high degree of convenience and flexibility, this advantage is correspondingly offset by the ease with which an unauthorized person can plug his personal telephone into another's outlet and make costly long distance telephone calls. This problem is increasing, and is especially prevalent in school dormitories or office building atmospheres where large numbers of persons have ready access to plugable telephone sockets.

Other areas which share a problem of a slightly different nature include the standard wall electrical outlet where it is desired to prevent children from sticking metallic objects into the outlet. The solution posed to this problem has been to insert plastic plugs into the electrical outlet to prevent the insertion therein of foreign objects. However, children quickly learn to remove the plugs, with the resultant exposure to the electrical hazard.

There is therefore a need for a protective cover which is relatively inexpensive, easy to install and which provides a high degree of security to the apparatus covered. In addition, there is a concomitant need to provide a security cover which is completely removable from the apparatus and which can be used with other similar apparatus as the need arises.

These problems have been addressed and the solution thereto may be found in the following description according to the principles of the present invention. Accordingly, the security cover of the invention includes a durable metallic cover which closely conforms to the outer dimensions of the apparatus to be covered. A fastening screw which typically fixes the protectable apparatus to the wall is removed, and a special double headed screw is used in place thereof. The outer shoulder or head of the screw, along with its connecting shank extend outwardly from the apparatus and is used as an anchor for lockable attachment thereto of the security cover locking means. The security cover includes a key cylinder lock mounted therein, and a slotted finger attached to the rotatable lock cylinder. In this manner, when the key is inserted into the lock and rotated, the slot in the finger engages with the shank of the special double-headed anchor screw and thereby lockably fixes the security cover over the apparatus.

In one embodiment of the invention the protective cover includes a pair of inwardly directed tangs on the peripheral edge thereof to provide an additional measure of security by preventing the protective cover from being pryed away from the protectable apparatus.

In another embodiment of the invention, rather than providing the tangs, and particularly for use with apparatus which is mounted to a surface with plural fasteners, the other fastener is replaced with a special double-headed anchor screw. An inwardly turned notched edge of the protective cover engages with the double-headed screw and thereby provides an additional measure of security.

BRIEF DESCRIPTION OF THE DRAWINGS

FIG. 1 of the drawings is an isometric view illustrating the security cover according to the invention, removed from a telephone wall outlet.

FIG. 2 is a cross-sectional side view of the security cover lockably attached to the telephone wall outlet taken along lines 2—2 of FIG. 3.

FIG. 3 is a partial cross-sectional view of the security cover, taken along line 3—3 of FIG. 2.

FIG. 4 is a cross-sectional view of the security cover which illustrates an alternative embodiment of the fastening means.

FIG. 5 is a partial cross-sectional view, taken along line 5—5 of FIG. 4, showing the protective cover slotted edge engaging with the double-headed anchor screw.

DETAILED DESCRIPTION OF THE INVENTION

Turning now to the drawings, and particularly to FIG. 1 thereof, there is shown a telephone wall outlet 10 adapted for engagement with the security cover assembly designated by reference character 12. For illustrative purposes, the security cover will be described in connection with its use with a telephone wall outlet 10, however, it should be understood that the present invention can be used with a variety of other apparatuses to be protected.

In the embodiment shown in FIG. 1, the protective cover 14 of the invention includes a peripheral side 16 which closely conforms to the size and shape of the corresponding peripheral side of the telephone outlet 10 to be protected. The protective cover 14 is constructed of heavy gauge steel to prevent destruction and to resist bending by those who would attempt to damage it. Of course, other durable materials can be used to form the protective cover.

Mounted in the cover 14 outer surface is a key cylinder lock 18. The location of the key cylinder lock 18 in the protective cover 14 is dictated generally by the location of the fasteners fastening the telephone wall outlet 10 to the wall (not shown).

The installation of the security cover 12 can be quickly accomplished, and requires little skill. This is especially advantageous as it does not require a craftsman to ready the apparatus to accept the security cover 12. When the illustrated apparatus comprises a telephone wall outlet, such as shown in the drawings, the original fastener must be removed and a special double-headed anchor screw 24 substituted therefor. The simple removal of the original fastener, and the replacement by the double-headed anchor screw 24 is the only task in preparing the telephone wall outlet 10 for use with the present invention. The other telephone wall outlet fastener 20 may be, if desired, loosened a small amount so that a pair of inwardly directed tangs 26 and 28 (partially shown in FIG. 1) can be slipped behind the top edge of the telephone wall outlet cover.

The tangs 26 and 28 may be tapered to a sharpened edge, as shown in FIG. 2, so that they may be wedgably forced between the upper edge of the telephone wall outlet 10 and the wall 56, thus eliminating the need to loosen fastener 20. This is an expedient method of installation as wallboard material, such as the gypsum drywall, or the wall outlet case itself may yield enough to accommodate the tangs 26 and 28 therebetween. In yet another alternative, the top edge of the telephone wall outlet 10 may be notched with a file, as shown by notches 30 and 32 to freely accept the respective tangs 26 and 28.

From the foregoing, it can be appreciated that with the primary locking engagement between the key cylinder lock 18 and double-headed anchor screw 24, as well as the secondary engagement of the tangs 26 and 28 with the telephone wall outlet case, unauthorized access to the telephone socket 34 is prevented. It will be described in detail immediately below how removal of the security cover 12, with the use of the cylinder lock key 36 is effected.

With attention directed now to FIGS. 2 and 3 of the drawings, the primary means by which the security cover 12 is locked to the apparatus will be described. The key cylinder lock 18 is conventional, and includes a nut 38 for generally attaching the lock to the protective cover 14. The cylinder 40 of the lock 18 is typically rotatable along with the key 36 when inserted thereinto. Attached to the lock cylinder 40, by a screw 42, is a notched finger 44. The outer part of the lock cylinder 40 is generally irregular in shape so that when the slotted finger 44, which also includes a similarly shaped hole, is inserted over the cylinder 40 the finger 44 is caused to be rotatably moved in response to key 36 movement.

As shown in FIG. 3, the finger 44 includes a slot 46 in one side edge thereof for engaging with the shank 48 of the double-headed anchor screw 24. Shown in FIG. 3 is the relative location of the cylinder lock 18 within the protective cover 14 such that the slot 46 of the locking finger 44 engages with the double-headed anchor screw shank 48 when the former is rotated toward the latter in response to the turning of the key 36.

With reference to FIG. 2 the locking finger 44 can be dog-leg shaped to assure that the slotted part thereof is at the proper elevation to engage with the anchor screw shank 48. The double-headed anchor screw 24 is of special design insofar as it includes a first head 50 for securing the telephone wall outlet case 10 firmly to the wall 56. A second head 52 is provided, and is connected to the first head 50 by the noted shank 48. With the provision of the second head 52 the engagement of the locking finger slot 46 with the anchor screw shank 48 prevents axial movement of the locking finger 44, and thus movement of the security cover 12 outwardly away from the telephone wall outlet 10. The locking finger 44 is constructed of a material which resists bending and thus prevents removal of the security cover 12 by those who would try to pry it off of the telephone wall outlet 10.

Significantly, the security cover 12 is secured to the anchor screw 24, and thus to the wall 56 through the locking finger 44 and key cylinder lock 18. Therefore, to remove the security cover 12 from the telephone wall outlet 10 without a key 36, the locking finger 44 must be bent, or the anchor screw 24 ripped from the wall material, a measure not usually resorted to by those who merely desire to make an unauthorized telephone call.

As shown in FIGS. 2 and 3, in addition to the primary lockable securing means 18, the tangs 26 and 28 are wedged between the wall 56 and the upper edge 58 of the telephone wall outlet 10 to thereby provide an additional measure of security.

In applying the security cover 12 to a telephone wall outlet, or other protectable apparatus, the tangs 26 and 28 are placed above the upper edge of the telephone wall outlet 10 and forced between the wall and such outlet 10 until the bottom of the protective cover 14 slides down around the corresponding bottom side of the telephone wall outlet 10. When the tangs 26 and 28 are firmly in place, and the security cover sides 16 are flush against the wall surface, the key 36 is turned in a direction so as to engage the locking finger 44 with the shank 48 of the double-headed anchor screw 24, whereupon the key is removed and the security cover 12 is firmly fixed over the outlet 10 thereby preventing unauthorized access. The security cover 12 is easily removed by inserting the key 36 into the key cylinder lock 18, and turning the key in the direction which disengages the locking finger 44 from the double-headed anchor screw 24. The bottom of the security cover 12 is then pulled outwardly slightly and pressure is applied upwardly to extract the tangs 26 and 28 wedged between the wall 56 and the telephone wall outlet 10.

With reference now to FIG. 4, there is shown another embodiment of the secondary securing means. Instead of the pair of tangs 26 and 28, the top edge of the protective cover 14 is turned inwardly so as to form a tab 60 across the inside top edge of the protective cover 14. The tab 60 is formed integral with the protective cover 14 and thus resists bending should unauthorized persons attempt to pry the cover 12 away from the apparatus. Provided in the tab 60 is a slot 62 which engages with a second double-headed anchor screw 64. The anchor screw 64 is of the same construction as that described above in connection with anchor screw 24, and replaces the other wall outlet fastener 20 (FIG. 1). With this arrangement, the security cover 12 includes a primary securing means (the cylinder lock 18 and locking finger 44) and a secondary securing means (the tab 60) both of which are indirectly secured to the wall 56 through respective special anchor screws 24 and 64. The term special anchor screw as used herein denotes that special provisions need to be taken to provide a means by which the locking finger 44 or the slotted tab 60 are attached to the apparatus. This provision may, of course, be addressed and accomplished by loosening the original screws of the apparatus and engaging the tab 60 or the locking finger 44 thereunder.

Shown and described above are the fundamental novel features of the invention as applied to the various embodiments. It will be understood that various omissions, substitutions and changes in the form and detail of the invention as described herein may be made by those skilled in the art without departing from the true scope of the invention as defined by the appended claims. It is therefore, the intention that the invention be limited only by the scope of the following claims.

What is claimed is:

1. A security cover in combination with and shaped for protecting a surface mounted apparatus, comprising:

a. a surface mounted apparatus having a defined peripheral configuration, b. a removable protective cover with peripheral sides shaped to closely fit around said apparatus and fit flush against a surface on which said apparatus is mounted;

c. first fastening means for securing said apparatus to said surface;

d. at least one tab integral with said protective cover and engaging said apparatus; said tab being disposed inwardly and orthogonal to a side of said protective cover, said tab being wedgeable between said surface upon which said apparatus is mounted and said apparatus;

e. second fastening means for securing said apparatus to said surface; and f. a key lock mounted on said protective cover and movably engageable with said second fastening means.

2. A security cover in combination with and for protecting a surface mounted apparatus mounted to a surface with a fastener, comprising:

a. a surface mounted apparatus having a defined peripheral configuration, b. first fastening means for connecting said apparatus to said surface and disposed proximate the upper part of said apparatus;

c. a removable protective cover having an outer surface, and peripheral side sufaces closely conforming to the peripheral configuration of said apparatus, d. an edge of said protective cover engaging said first fastening means;

e. said fastener comprising a double-headed fastener, one head of said double-headed fastener for securing said apparatus to said surface;

f. a key lock with a key rotatable cylinder, and mounted in the outer surface of said protective cover, said lock including a finger fixed to said cylinder and engageable with said double-headed fastener when said cylinder is rotated in response to the turning of said key;

g. whereby the engagement of said protective cover with said apparatus protects against removal of said cover and unauthorized access to said apparatus.

3. The security cover of claim 2 wherein said finger includes a slot engageable around said double-headed fastener and under the other head thereof.

4. A security cover in combination with and adapted for lockably fixing to a rectangular telephone wall outlet which is secured to a surface with a fastener, comprising:

a. a telephone wall outlet having an aperture for passage of a fastener, b. a removable rectangular cover with at least three sides fitting closely around three respective side edges of said telephone wall outlet, and an outer face integral with the sides thereof and for covering a telephone socket mounted in said telephone wall outlet, said cover further having a hole in said outer face laterally spaced from said aperture when disposed under said cover;

c. engaging means integral with said cover and disposed proximate a side thereof shaped for engaging with said telephone wall outlet so as to prevent said cover from being pulled away from said wall outlet when engaged therewith;

d. screw fastening means passing through said aperture for securing said telephone wall outlet to a surface, and including an engaging head;

e. a key lock with a key rotatable cylinder mounted in said hole, said lock including a finger fixed to said cylinder and engageable with said engaging head of said fastening means when rotatable with said cylinder, whereby when said cylinder is rotated by a key said cover becomes lockably fixed to said fastening means and to said telephone wall outlet thus preventing unauthorized access to said telephone socket.

5. The security cover of claim 4 wherein said engaging means includes a pair of tangs integral with an edge of one cover side and oriented so as to wedge between said surface and the backside of said telephone wall outlet.

* * * * *